United States Patent [19]

Legille et al.

[11] Patent Number: 4,821,998

[45] Date of Patent: Apr. 18, 1989

[54] MECHANISM FOR OPERATING A METERING VALVE

[75] Inventors: Edouard Legille, Luxembourg; Emile Lonardi, L-Bascharage, both of Luxembourg

[73] Assignee: Paul Wurth S.A., Luxembourg, Luxembourg

[21] Appl. No.: 122,956

[22] Filed: Nov. 19, 1987

[30] Foreign Application Priority Data

Nov. 21, 1986 [LU] Luxembourg ..... 86680

[51] Int. Cl.[4] ..... F16K 31/122

[52] U.S. Cl. ..... 251/58; 74/471 R; 74/519; 91/363 R; 222/52; 251/212; 251/229; 251/232; 251/279; 364/183; 364/167.01

[58] Field of Search ..... 91/361, 363 R; 251/57, 251/58, 28, 212, 229, 129.01, 129.04, 232, 279, 280; 364/167, 183; 414/169, 200, 221; 222/52, 64; 74/471 R, 519

[56] References Cited

U.S. PATENT DOCUMENTS

| | | | |
|---|---|---|---|
| 2,781,743 | 2/1957 | Mann et al. | 91/363 R |
| 3,038,449 | 6/1962 | Murphy, Jr. et al. | 91/363 R |
| 3,317,179 | 5/1967 | Willis | 251/58 |
| 3,902,694 | 9/1975 | Friedell | 251/58 |
| 3,998,426 | 12/1976 | Isbester | 251/212 |
| 4,037,519 | 7/1977 | Miller et al. | 91/361 |
| 4,158,367 | 6/1979 | Mailliet | 251/58 |
| 4,513,782 | 4/1985 | Contartese et al. | 91/363 R |
| 4,514,129 | 4/1985 | Legille et al. | 251/212 |
| 4,570,900 | 2/1986 | Lonardi et al. | 251/58 |
| 4,694,390 | 9/1987 | Lee | 364/167 |

FOREIGN PATENT DOCUMENTS

| | | | |
|---|---|---|---|
| 1055606 | 2/1954 | France | 251/212 |
| 1147940 | 12/1957 | France | 251/212 |
| 2154803 | 5/1973 | France . | |
| 0038875 | 4/1978 | Japan | 91/361 |
| 1120278 | 7/1968 | United Kingdom . | |

*Primary Examiner*—George L. Walton

*Attorney, Agent, or Firm*—Fishman, Dionne & Cantor

[57] ABSTRACT

A metering valve comprised of two rotary registers are each provided with cutouts which are symmetrical in relation to the axis of the central opening defined by the movement of the registers. In accordance with the present invention, a mechanism for operating the registers synchronously and in opposite directions is composed of levers and connecting rods acting on the axis of suspension and rotation of the registers through the action of, for example, hydraulic jacks. In order to avoid the offsetting of the flow because of the difference between the radii of curvature of the registers, the entire mechanism is adapted to pivot as a whole about the pivot axis of the registers.

16 Claims, 5 Drawing Sheets

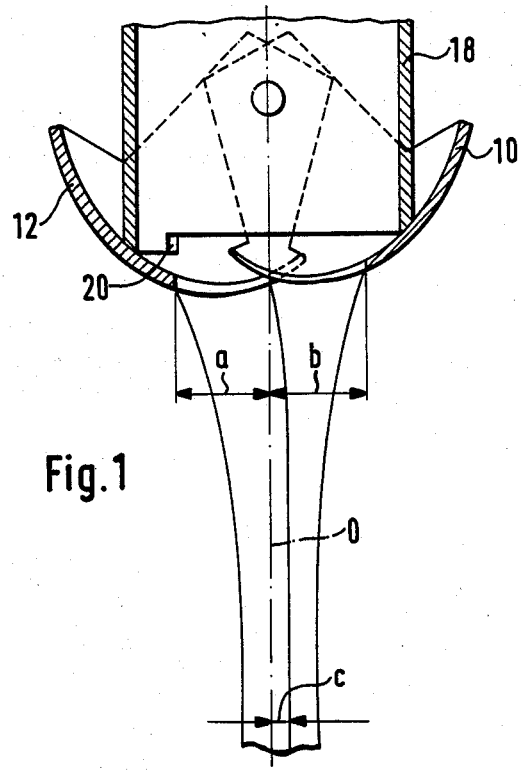
Fig. 1
Fig. 2
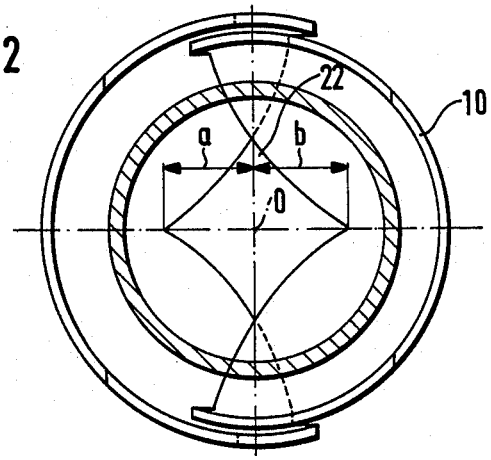

MECHANISM FOR OPERATING A METERING VALVE

BACKGROUND OF THE INVENTION

The invention relates to a mechanism for operating a metering valve comprising two rotary registers shaped as spherical or cylindrical domes and provided with cutouts which are symmetrical in relation to the axis of a central opening defined by the movement of the registers and cutouts. The registers are fastened to two drive shafts disposed coaxially in relation to one another and received in the bearings of a flow tube. By pivoting about their common axis, each of the registers are operated synchronously and in opposite directions. Each of the two shafts is provided with an arm, each arm being articulated by means of a connecting rod on a rocking lever mounted on a pivot axis parallel to the common axis of the two shafts. The rocking levers are connected to drive device pivoting them about their pivot axis. The articulation between one of the rocking levers and its connecting rod is angularly offset about the pivot axis in relation to the articulation between the other rocking lever and its connecting rod.

A mechanism of the type contemplated by the present invention is described in European Pat. No. 0,134,918, corresponding to U.S. Pat. No. 4,570,900, assigned to the assignee hereof, all of the contents of which are incorporated herein by reference. U.S. Pat. No. 4,570,900 discloses an apparatus for regulating the flow of charge material from a storage container disposed on the central axis of a shaft furnace charging plant. This prior device discloses means for controlling the registers in such a manner that the flow opening delimited by the cutout, will be modified symmetrically in relation to the central axis.

The use of the metering system of U.S. Pat. No. 4,570,900 results in a certain irregularity in the level of the charging surface of the furnace. This irregularity has, in addition, been confirmed by tests. The tests have shown that these irregularities are due to the offsetting (in relation to the vertical axis), of the flow of charge material flowing through a symmetrical opening defined between the two registers. It is true that this offset is very slight and that its effect on the charging profile varies in accordance with the angular position of the spout. However, since the same effects always occur in the same angular positions (viewed in plan) of the spout, the accumulation of these irregularities as successive deposited layers finally gives rise to a non-negligible deviation from the charge level profile which it is desired to obtain.

It has been found that the cause of this offset of the flow current is due to the difference in the curvature of the domes of the two registers, one of which must have a radius greater than that of the other. It will be appreciated that this offsetting phenomenon will be better understood and described in greater detail further on, in connection with the drawings.

SUMMARY OF THE INVENTION

The above-discussed and other problems and deficiencies of the prior art are overcome or alleviated by the apparatus of the present invention which provides an improved mechanism for enabling the offset of the flow current to be eliminated regardless of the angular positions of the two registers.

In accordance with the present invention, a metering apparatus of the type comprising two rotary spherically or cylindrically shaped registers with cutouts which are symmetrical with respect to a central opening defined by the movement of the registers is provided wherein the entire apparatus is movable as a whole about the pivot axis of the registers. This is accomplished by mounting the entire mechanism for rotation in a cylindrical sleeve, which in turn is mounted rotatably in a flow tube.

Preferably, the rotation of the cylindrical sleeve, which entails the rotation of the entire mechanism, is provided by a hydraulic jack. The present invention also provides a control circuit incorporating a first detector for the angle of opening of the registers, a second detector for the actual position of the jack, a comparator comparing the actual position of the jack with a stored set position dependent on the angular positions of the registers and a hydraulic valve whose control is dependent on the result of the comparison made by the comparator. The hydraulic valve operates the jack until the actual position of the jack corresponds to the set position.

The apparatus of the present invention thus makes it possible to automatically modify the orientation of the registers in relation to the central axis so that the flow is symmetrical to said axis.

The above discussed and other features and advantages of the present invention will be appreciated and understood by those of ordinary skill in the art from the following detailed description and drawings.

BRIEF DESCRIPTION OF THE DRAWINGS

Referring now to the drawings, wherein like elements are numbered alike in the several Figures:

FIG. 1 is a cross sectional elevation view through a metering valve operated in accordance with the prior art;

FIG. 2 is a plan view of the prior art valve shown in FIG. 1;

DESCRIPTION OF THE PREFERRED EMBODIMENT

Figure 3:
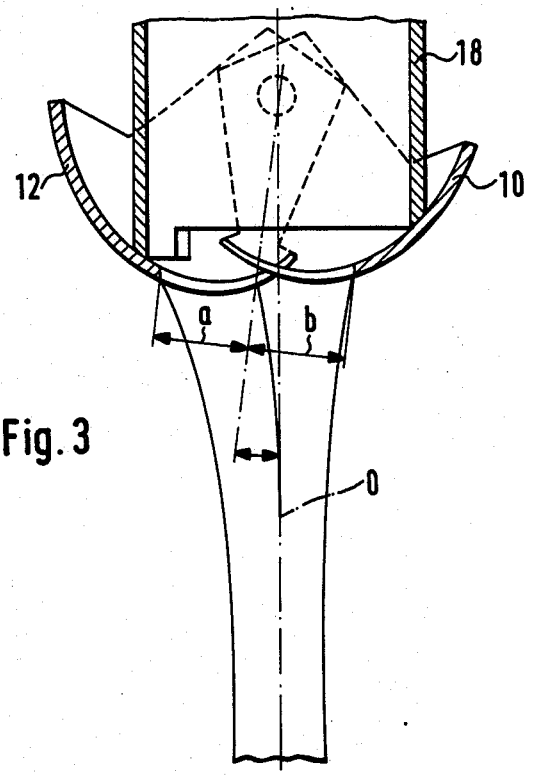
FIG. 3 is a cross sectional elevation view of a valve operated by the mechanism in accordance with the present invention.

FIGS. 1 and 2 show a conventional metering valve of the type disclosed in the above mentioned U.S. Pat. No. 4,570,900. This valve comprises two registers 10 and 12 having the shape of a spherical dome and adapted to pivot in opposite directions about a common axis under a flow tube 18. The two registers 10 and 12 have triangular cutouts, and the mechanism for operating these registers is designed in such a manner as to pivot the registers in opposite directions in order to form a flow opening 22 which is substantially square in shape and perfectly symmetrical in relation to the central axis 0. In other words, the horizontal distances a and b from the bottom of each of the register cutouts to the central axis 0 are equal to one another whatever the angular position of registers 10 and 12. As FIG. 1 shows, tests have revealed that a symmetrical opening produces a flow which is asymmetrical inasmuch as the flow current is offset by a distance c from the central axis 0. This offset appears to be caused by the fact that the registers must have different radii of curvature. In the example illustrated, register 12 has the larger radius of curvature, which can be seen from the step 20 on the bottom edge of tube 18. The curvature of register 10 is therefore less than that of the register 12. As FIG. 1 shows, the offset of the flow current occurs on the opposite side to that where the register having the larger radius of curvature is positioned. It therefore seems that the register having the smaller radius of curvature has a greater braking effect, or inversely that the register having the larger radius of curvature contributes towards a freer flow.

Figure 4:
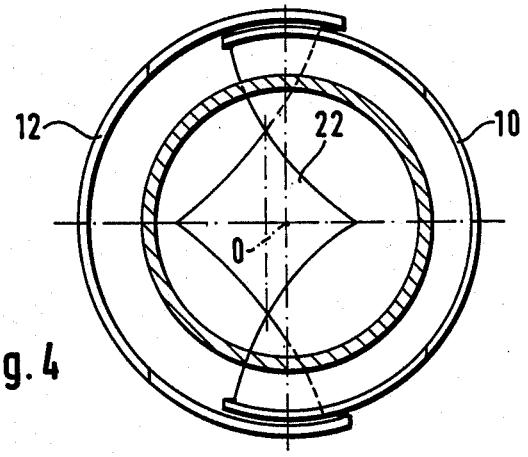
FIG. 4 is a cross sectional elevation view of the valve of FIG. 3.

Referring now to FIGS. 3 and 4, in accordance with the present invention, this phenomenon is eliminated by pivoting the two registers through an angle in relation to the axis 0. As a result, the flow opening 22 shown in projection in FIG. 4 becomes asymmetrical in relation to the central axis 0, but the flow current will be formed symmetrically around said axis, as shown in FIG. 3.

Figure 5:
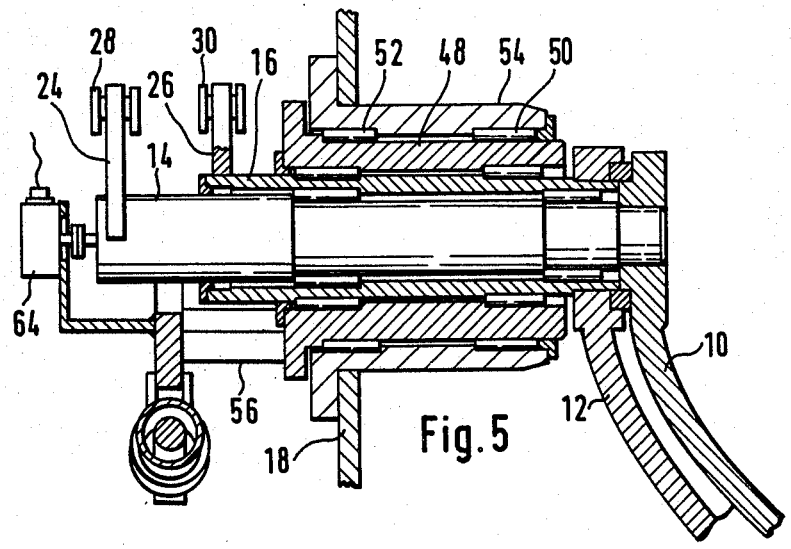
FIG. 5 is an elevation view, partly in cross section, of the metering valve operating mechanism of the present invention.

The mechanism in accordance with the present invention which is employed to pivot the two registers 10 and 12 will be described with reference to the following Figures. However, a brief description of the valve operating mechanism will first be given with reference to FIGS. 5 and 7, this mechanism being similar to that proposed by the above mentioned U.S. Pat. No. 4,570,900, to which reference should be made for more detail.

The top register 10 having the smaller radius is fastened to a drive shaft 14 disposed coaxially inside a second drive shaft 16 to which the lower register 12 is fastened. These two shafts 14 and 16 pass through flow tube 18. The two shafts 14 and 16 are adapted to turn relative to one another about their common axis and relative to tube 18 because of the interposition of bushes or bearings known per se.

Shafts 14 and 16 are fastened respectively to arms 24 and 26, each of which is articulated to one end of a connecting rod 28, 30. The opposite ends of these two connecting rods 28 and 30 are in turn articulated respectively to one end of two rocking levers 32 and 34 mounted on a common pin 36 parallel to the axis of rotation of the two drive shafts 14 and 16 and adapted to pivot about said common pin 36. These two rocking levers 32, 34 are connected together at their other ends by means of a rod 38, so that levers 32 and 34 must necessarily pivot together about the pin 36. In order to increase strength, it is preferable for levers 32 and 34 to be welded together by means of braces (not shown).

The pivoting of rocking levers 32 and 34 is brought about by a hydraulic cylinder or jack 40, which is pivotally mounted on a pivot 44 carried by a support plate 46. Rod 38 connecting together the two levers 32 and 34 passes through the end of rod 42 of jack 40.

In accordance with an important feature of the present invention, the two registers 10, 12, their suspensions and their drive mechanisms are supported in tube 18 for rotation as a whole about the longitudinal axis of shafts 14, 16 in relation to tube 18. For this purpose, outer shaft 16 is received and supported in a cylindrical sleeve 48 and is adapted to turn in relation to the latter though the interposition of appropriate bushes or bearings 50. Sleeve 48 is itself adapted to turn inside a bearing 54 with the interposition of bushes or bearings 52. Sleeve 48 is, in addition fastened to the support plate 46 by one or more braces 56.

Figure 6:
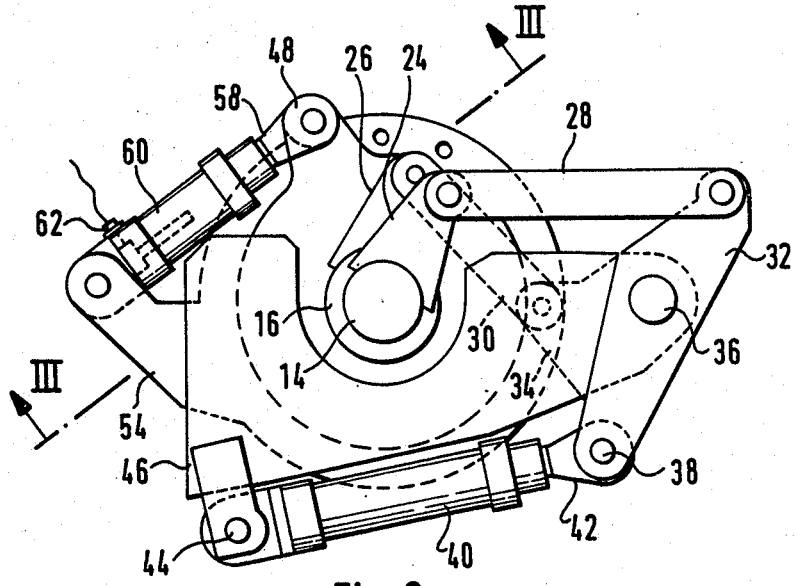
FIG. 6 is a side elevation view, in the axial direction, of the register drive shafts.
Figure 7:
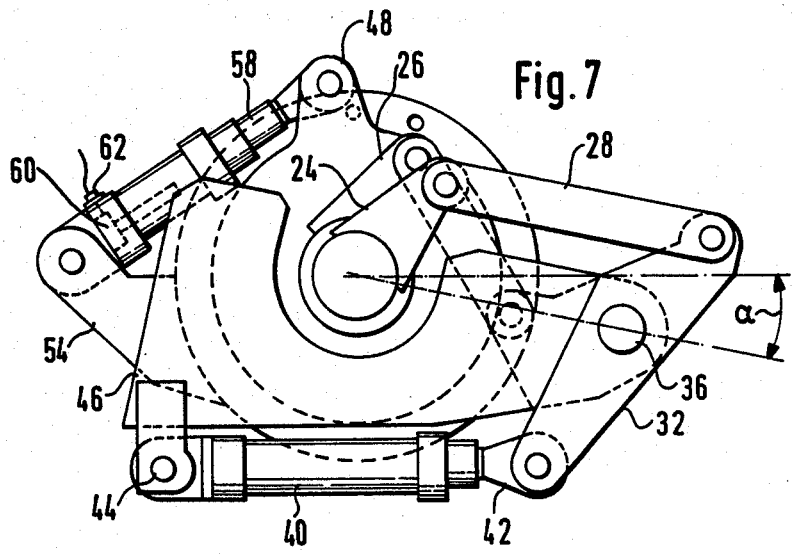
FIG. 7 is a side elevation view, similar to that shown in FIG. 6, after rotation of the mechanism through an angle.
Figure 8:
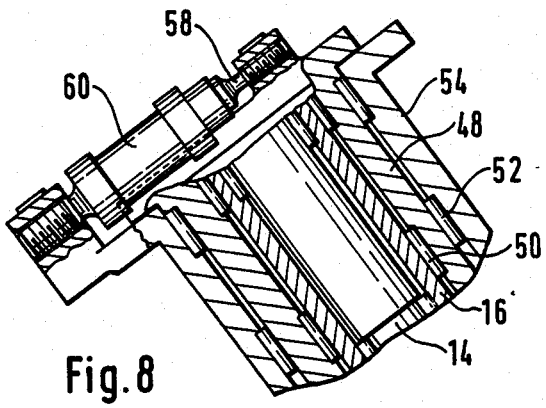
FIG. 8 is an elevation view, partly in cross section along the sectional plane VIII—VIII in FIG. 6.

As shown in FIGS. 6 to 8, sleeve 48 is connected to the end of the piston rod 58 of a jack 60, the opposite end of which is articulated on the fixed bearing 54. Jack 40 incorporates a probe 62, known per se, supplying signals representing the position of jack 60, that is, the state of extension of rod 58. As shown in FIG. 7, a clearance on rod 58 of jack 60 gives rise to the rotation of sleeve 48 through an angle $\alpha$ about the pivot axis of registers 10 and 12 and, because of the fastening of sleeve 48 to support plate 46, a corresponding rotation of the two shafts 14 and 16 and of the registers 10 and 12 about the same axis.

Figure 9:
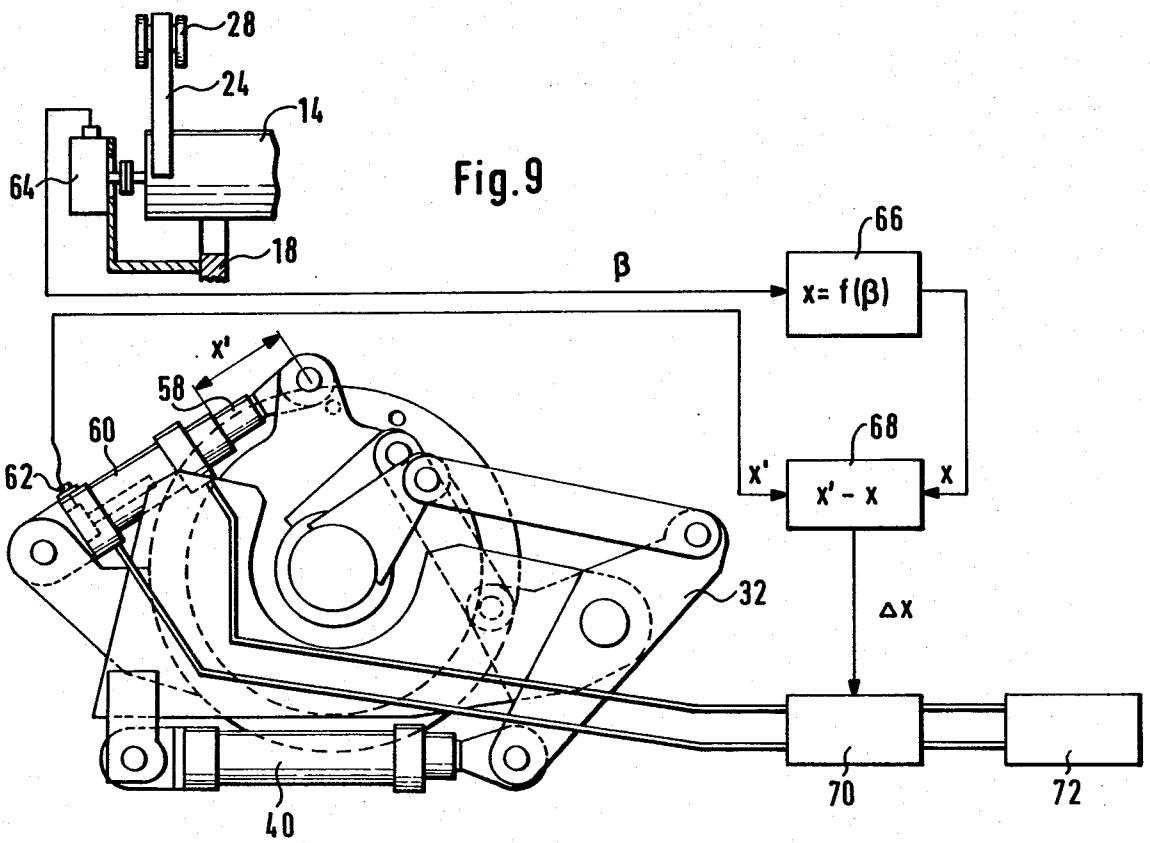
FIG. 9 is a block diagram of the control circuit for use with the metering valve operating mechanism of the present invention.

FIG. 9 shows a control circuit for the rotation of sleeve 48 in response to the angular opening of registers 10 and 12. An angular position detector 62, known per se, is associated with shaft 14 to permanently indicate the angular position $\beta$ of register 10 in relation to a reference position, for example its closed position. This information is transmitted to a memory 66, in which set valve information is stored for the optimum angular position $\alpha$ of sleeve 38 in response to the angular opening position $\beta$ of register 10 for different types of materials and different rates of flow. This information is obtained by previous tests and relates to the length of extension X of rod 58 of the jack 60. The memory 66 thus establishes the desired values X of the amplitude of the extension of rod 58 in response to the angular positions measured by detector 64. This information is transmitted to a comparator 68. The latter also receives, from the detector incorporated in jack 60, information concerning the actual amplitude X' of the extension of rod 58. Comparator 68 controls a hydraulic valve 70 which regulates the rate of flow and direction of circulation of the hydraulic fluid between a pump 72 and jack 60.

If comparator 68 detects a difference $\Delta X$ between the desired valve position X and the actual position X', the valve 70 is operated to circulate the hydraulic fluid in the appropriate direction to reduce the difference $\Delta X$ and make the actual position X' correspond to the desired valve position X. For example, if the angular position $\alpha$ is too small, X' will be lower than X. In this case, valve 70 will deliver hydraulic fluid into the cylinder of the jack to extend the rod 58 and increase the amplitude of X' until equality with the desired value X is achieved.

The arrangement shown in FIG. 9 permits two different modes of operation. It is possible to pivot sleeve 48 by means of jack 60, with the registers 10 and 12 closed, as far as its desired valve position stored in 66, without this being response to the opening angle $\beta$. Once the desired value position $\alpha$ is reached, the action on jack 60 is interrupted and the hydraulic jack 40 is operated to move the two registers 10 and 12 in synchronism and in opposite directions. In the second operating mode, jack 40 is operated from the start to open the two registers 10 and 12 at the same time. However, jack 60 is operated progressively and in response to the opening angle $\beta$ of the registers 10, 12 in accordance with the desired values stored in 66. Starting from the maximum opening position of register 12, as illustrated in FIG. 3, it is possible, in order to be able to open register 10 completely, to operate jack 60 in the opposite direction so as to prevent register 12 from striking against tube 18.

One advantage of the apparatus of the present invention is that it is adaptable to different flow rates. Another advantage is that it can be adapted to the characteristics of different charge materials.

Yet another advantage of the present invention is that the operator is enabled to intervene with respect to the centering of the flow current while the blast furnace is in operation. In other words, the operator can, with the aid of measuring apparatus of a suitable type, determine the degree of uniformity of the charge deposited in the furnace and take appropriate action with respect to the metering valve.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An apparatus for operating a metering valve comprising two rotary registers provided with cutouts which are symmetrical with respect to a vertical axis of a central opening defined by the movement of the registers and cutouts, the registers being fastened respectively to first and second drive shafts disposed coaxially in relation to one another and received in bearings of a flow tube such that by pivoting about their common axis, each of the registers operates synchronously and in opposite directions, and further comprising:

first arm means provided to said first drive shaft;

second arm means provided to said second drive shaft;

first connecting rod means pivotably connected to a first rocking lever means, said first rocking lever means being pivotably mounted on a pivot axis, said pivot axis being parallel to the common axis of said first and second drive shafts, said first arm means being articulated to said first connecting rod means;

second connecting rod means pivotally connected to a second rocking lever means, said second rocking lever means being pivotably mounted on a pivot axis, said pivot axis being parallel to the common axis of said first and second drive shafts, said second arm means being articulated to said second connecting rod means;

drive means, said first and second rocking lever means being pivotably connected to said drive means wherein said drive means pivots said first and second rocking lever means about said pivot axis;

wherein the connection between said first rocking lever means and said first connecting rod means is angularly offset about said pivot axis in relation to the connection between said second rocking lever means and said second connecting rod means; and moving means forming the entire apparatus as a whole about the pivot axis of the two rotary registers for modifying the orientation of said registers with respect to said vertical axis in order to maintain a symmetrical flow to said vertical axis.

2. The apparatus of claim 1 wherein said moving means includes:

rotatable sleeve means, said entire apparatus being mounted for rotation in said rotatable sleeve means; and bearing means fixed to said flow tube, said rotatable sleeve means being mounted for rotation in said bearing means.

3. The apparatus of claim 2 wherein:

said sleeve means is cylindrical.

4. The apparatus of claim 2 including:

means acting on said sleeve means to rotate said sleeve means.

5. The apparatus of claim 3 including:

means acting on said sleeve means to rotate said sleeve means.

6. The apparatus of claim 4 wherein:

said means acting on said sleeve means comprises hydraulic cylinder means.

7. The apparatus of claim 6 including:

control circuit means for controlling said hydraulic cylinder means.

8. The apparatus of claim 7 wherein said control circuit means comprises:

first detector means for detecting the angle of opening of said two registers;

second detector means for detecting the actual position of said hydraulic cylinder means;

comparator means for comparing the actual position of said hydraulic cylinder means with a stored set position in response to the angular positions of said two registers as indicated by said first detector means;

hydraulic valve means for operating said hydraulic cylinder means until the actual position of said hydraulic cylinder means corresponds to the stored set position based on the comparison made by said comparator means.

9. In a apparatus for operating a metering valve comprising two rotary registers provided with cutouts which are symmetrical with respect to a vertical axis of a central opening defined by the movement of the registers and cutouts, the registers being fastened respectively to first and second drive shafts disposed coaxially in relation to one another and received in bearings of a flow tube such that by pivoting about their common axis, each of the registers operates synchronously and in opposite directions, and further comprising first arm means provided to said first drive shaft, second arm means provided to said second drive shaft, first connecting rod means Pivotably connected to a first rocking lever means, said first rocking lever means being pivotably mounted on a pivot axis, said pivot axis being parallel to the common axis of said first and second drive shafts, said first arm means being articulated to said first connecting rod means, second connecting rod means pivotally connected to a second rocking lever means, said second rocking lever means being pivotably mounted on a pivot axis, said pivot axis being parallel to the common axis of said first and second drive shafts, said second arm means being articulated to said second connecting rod means, drive means, said first and second rocking lever means being pivotably connected to said drive means wherein said drive means pivots said first and second rocking lever means about said pivot axis, the connection between said first rocking lever means and said first connecting rod means being angularly offset about said pivot axis in relation to the connection between said second rocking lever means and said second connecting rod means, the improvement comprising:

for moving means for moving entire apparatus as a whole about the pivot axis of the two rotary registers for modifying the orientation of said registers with respect to said vertical axis in order to maintain a symmetrical flow to said vertical axis.

10. The apparatus of claim 9 wherein said moving means includes:

rotatable sleeve means, said entire apparatus being mounted for rotation in said rotatable sleeve means; and bearing means fixed to said flow tube, said rotatable sleeve means being mounted for rotation in said bearing means.

11. The apparatus of claim 10 wherein:

said sleeve means is cylindrical.

12. The apparatus of claim 10 including:

means acting on said sleeve means to rotate said sleeve means.

13. The apparatus of claim 11 including:

means acting on said sleeve means to rotate said sleeve means.

14. The apparatus of claim 12 wherein:

said means acting on said sleeve means comprises hydraulic cylinder means.

15. The apparatus of claim 14 including:

control circuit means for controlling said hydraulic cylinder means.

16. The apparatus of claim 15 wherein said control circuit means comprises:

first detector means for detecting the angle of opening of said two registers;

second detector means for detecting the actual position of said hydraulic cylinder means;

comparator means for comparing the actual position of said hydraulic cylinder means with a stored set position in response to the angular positions of said two registers as indicated by said first detector means;

hydraulic valve means for operating said hydraulic cylinder means until the actual position of said hydraulic cylinder means corresponds to the stored set position based on the comparison made by said comparator means.

* * * * *